US006164468A

United States Patent [19]

Erdmann

[11] Patent Number: 6,164,468

[45] Date of Patent: Dec. 26, 2000

[54] JIB POSITIONING WITH HYDRAULIC ADJUSTMENT CYLINDER

[75] Inventor: Gerd Erdmann, Unterägeri, Switzerland

[73] Assignee: Grove U.S. L.L.C., Shady Grove, Pa.

[21] Appl. No.: 09/334,726

[22] Filed: Jun. 17, 1999

[30] Foreign Application Priority Data

Jun. 17, 1998 [DE] Germany ..... 198 26 924

[51] Int. Cl.[7] ..... B66C 23/04

[52] U.S. Cl. ..... 212/348; 212/292

[58] Field of Search ..... 212/348, 349, 212/550, 392, 230, 231

[56] References Cited

U.S. PATENT DOCUMENTS

| | | | |
|---|---|---|---|
| 3,782,790 | 1/1974 | Benkowski . | |
| 3,830,376 | 8/1974 | Fritsch . | |
| 3,836,011 | 9/1974 | Sakamoto et al. . | |
| 3,863,406 | 2/1975 | Quick | 212/349 |
| 3,921,819 | 11/1975 | Spain | 212/349 |
| 3,931,698 | 1/1976 | Ebersold . | |
| 4,337,601 | 7/1982 | Vaerk et al. . | |
| 5,628,416 | 5/1997 | Frommelt et al. | 212/349 |

FOREIGN PATENT DOCUMENTS

| | | |
|---|---|---|
| 2600384 | 12/1987 | France . |
| 60-13289 | 7/1985 | Japan . |
| 1164202 | 6/1986 | U.S.S.R. . |
| 937319 | 6/1982 | United Kingdom . |
| 2125004 | 2/1984 | United Kingdom . |
| 1615145A1 | 12/1990 | United Kingdom . |

*Primary Examiner*—Thomas J. Brahan

[57] ABSTRACT

Apparatus for fixing the angular position of two telescopic parts relative to each other, comprising a stopper arranged on the first telescopic part and an adjuster provided with a shiftable element arranged on the second telescopic part. The adjuster comprises a piston/cylinder unit arranged on the inner telescopic part, which may be actuated by fluid supply and discharge, as well as an arrangement and method for fixing two telescopic parts of a crane jib.

12 Claims, 2 Drawing Sheets

JIB POSITIONING WITH HYDRAULIC ADJUSTMENT CYLINDER

BACKGROUND OF INVENTION

The present invention relates to a means for laterally guiding or fixing the angular position of two telescopic parts relative to each other. More specifically, the present invention relates to a hydraulic guidance actuator assembly for a crane jib.

Telescopic parts, more particularly those as used for vehicular cranes, are provided with a fixing means so that during installation, or less frequently also when repair is needed, an extensible telescopic part can be set relative to the supporting telescopic part guiding the extensible telescopic part, for example, by a clasping action. These fixing means need to be designed in part so that they act perpendicular to the main direction of deformation of the telescopic parts, i.e., in the horizontal plane for example, in the case of a horizontally located telescopic jib (crane jib in the down condition), perpendicularly loaded downwards. This means that the location of a telescopic part can be maintained in this horizontal plane by the fixing means to achieve optimum alignment of two telescopic parts relative to each other.

The terms "horizontal" and "vertical" as orientation indications used in this context relate to the down condition of a jib consisting of telescopic parts, i.e. oriented horizontally substantially parallel to the ground.

Conventional fixing means for telescopic parts having substantially rectangular cross-sections comprise in the lower cross-sectional area of an inner telescopic part stoppers applied to both sides which are also termed guide plates. In this arrangement an adjuster applied to the outer telescopic part consists of a lockable setscrew, the face surface area of which, when screwed in, comes into contact with the main surface area of the stopper. The contact surface area between the setscrew and guide plate runs parallel to the vertical, main direction of deformation, so that also in loaded operation of the jib it can be assured that contact is made with this surface area, thus defining the position.

Accordingly, in this fixing arrangement the setscrew is screwed into a setscrew hub provided in the outer telescopic part until the setscrew is in snug contact with the guide plate at its face surface area. Since it is accessible on the outside of the outer telescopic part such a fixing means offers greatly facilitated handling.

More recently, however, jib profiles have become popular comprising lower rounded shell sections which are usually curved outwards, thus causing major problems in continuing to use the conventional system for a fixing means, as described above, in the region of lower, curved telescopic part shells.

In attempting to provide a setscrew accessible from without in such lower curved regions, which can be screwed in horizontally so that the vertically oriented face surface area is in turn able to come into contact with a vertically oriented guide plate bearing surface the collar and the guide in the region of the setscrew would have to be provided with large openings to permit passage of the setscrew. This has an additional negative effect on the steady-state loading capacity of the lower shell.

SUMMARY OF THE INVENTION

It is thus a primary object of the present invention to provide a means for laterally guiding and fixing two telescopic parts relative to each other which can also be put to use in the case of telescopic parts having lower curved shell-shaped sections.

It is more particularly the object of the present invention to provide a fixing means having good accessibility without adversely affecting the steady-state loading capacity.

These objects are achieved in accordance with the invention by the adjuster of the fixing means comprising a piston/cylinder unit arranged on the inner telescopic parts which may be actuated by fluid supply/discharge.

In other words, the adjuster including the shiftable element is relocated from the outer telescopic part to the inner telescopic part where a mounting can be made advantageously, which is not supported predominantly directly by the lower shell. It is advantageously made possible in accordance with the invention to mount a horizontally shiftable element of the adjuster so that problems regarding the steady-state loading capacity of the lower shell are avoided. The passage for the shiftable element is included in the inner telescopic part at a location in the footing thereof where the loading moment is less, thus making for a design advantage as compared to conventional fixing means in which the passage (setscrew hub) was located in the stem portion of the outer telescopic part. In accordance with the invention it is merely the stopper that is applied to the outer telescopic part, the mounting of which results in no weakening of the structure.

In one preferred embodiment of the present invention the abutment surface area is located between the stopper and the shiftable element in the main direction of deformation of the telescopic parts parallel to the vertical, longitudinal center plane of the latter. Both the shiftable element and the stopper thus have abutment surface areas extending vertically, as a result of which it is again assured that in loaded operation these abutment surface areas are in contact at all times, as a result of which relative fixing is also assured in the case of curved lower shells.

Preferably the shiftable element in accordance with the invention is horizontally shiftable and the stopper comprises at least one surface area section located parallel to a front face surface area of the shiftable element.

In one aspect in accordance with the present invention the piston of the piston/cylinder unit is the component that serves as the shiftable element, the piston/cylinder unit itself then comprising a pressurizing space located in the direction of the telescopic part interior, which may be filled more particularly with hydraulic fluid or grease and featuring an outer connection which is accessible from without through openings in the telescopic parts in the operating position of the fixing means. By applying hydraulic fluid or grease to the pressurizing space of the cylinder the piston of the piston/cylinder unit is thus caused to come into snug contact with the stopper to undertake fixing.

In accordance with the invention, such a pressurizing space is readily accessible at its outer connection when minor openings are provided in the telescopic parts where they do not detriment the steady-state loading capacity, i.e. where the piston is located at the stopper when the openings overlap. Gaining access to the outer connection of the pressurizing space via the openings is now greatly facilitated by means of a hydraulic hose or a pressurized grease hose so that fixing can be undertaken from without by simple ways and means.

A vehicular arrangement in accordance with the invention for two telescopic parts of a crane jib, more particularly for a vehicular crane, comprises two fixing means as described above, arranged in the lower portion of the telescopic parts, positioned substantially in a mirror-inverse arrangement relative to the vertically longitudinal center plane of the jib. As already mentioned above, this fixing arrangement may comprise fixing means in accordance with the invention which are arranged on the lower telescopic sections configured curved or oriented inclined to the longitudinal center plane.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
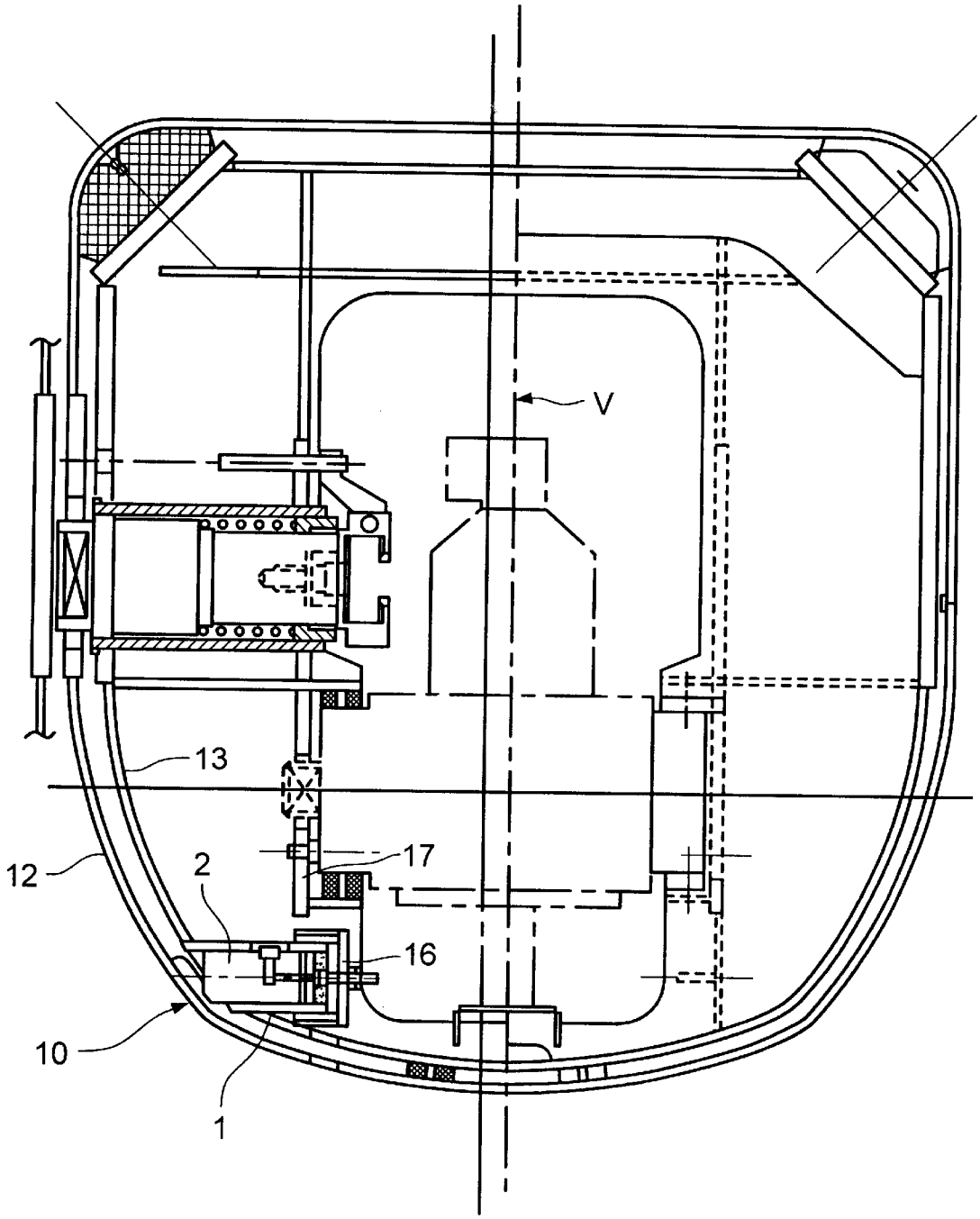
FIG. 1 is a view, partly in cross section, through two overlapping telescopic parts of a vehicular crane jib having a fixing means in accordance with the invention arranged in the left, lower shell portion.

The cross-section as shown in FIG. 1 illustrates an outer telescopic part 12 and an inner telescopic part 13 each of which comprise in the lower portion shell-shaped segments curved outwards. In the left-hand lower section the fixing means 10 is provided, with which the angular position of the telescopic parts 12 and 13 can be maintained relative to each other. To enable fixing to be undertaken on both sides another fixing means 10 is likewise provided on the opposite side, this fixing means not being visible, however, in this half-section.

FIG. 1 serves to make the location of the fixing means 10 clear in the arrangement as a whole, it being more particularly evident that the mounting element 16 for fixing means 10 is supported primarily by a vertically oriented beam 17, i.e. without requiring any fasteners which would substantially reduce the steady-state loading capacity to be provided in the shells themselves. The substantial parts of the guiding device, namely the stopper 9, the piston 2 and the cylinder 1 are evident from FIG. 1; their functioning and arrangement being depicted more precisely from FIG. 2.

Figure 2:
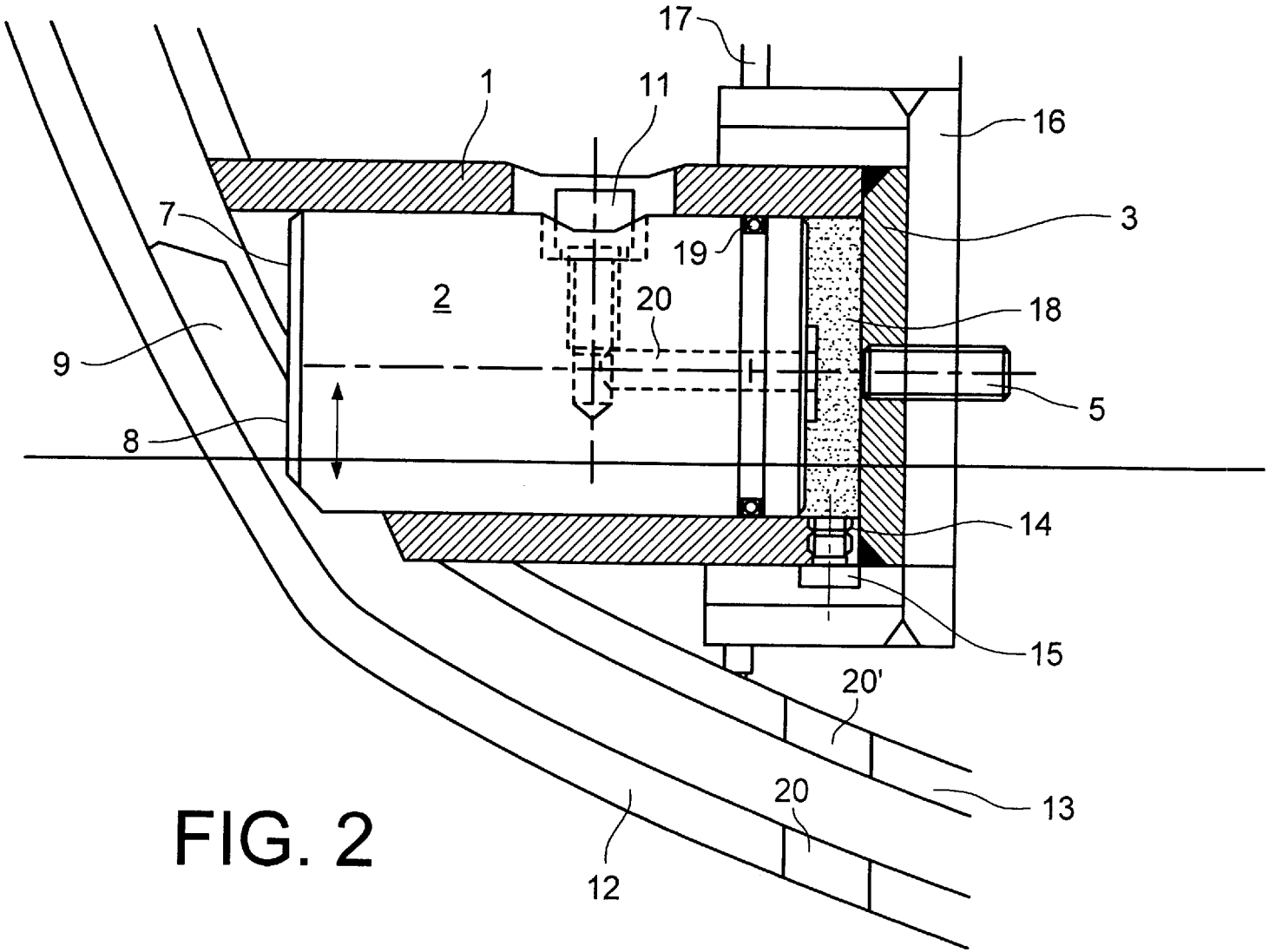
FIG. 2 is a partial sectional view of the fixing means of FIG. 1 on a magnified scale.

FIG. 2 illustrates the region of the fixing means 10 on a magnified scale, again illustrating the outer and inner telescopic shells 12 and 13. Secured to the curved outer telescopic shell 12 on the inside is the stopper 9. This stopper 9 comprises a surface area section 8, which in the fixing action abuts the front face surface area 7 of the piston.

The contact surface area of the surface areas 7 and 8 are oriented parallel to the vertically longitudinal center plane V (see FIG. 1) so that it is assured at all times that these surface areas come into contact even when the jib is operated under load.

The piston 2 is movably located in the cylinder 1. On the right-hand side the cylinder 1 comprises the cylinder bottom 3 which is held in place in the mount 16 by means of a fastener bolt 5, the mount in turn, as evident from FIG. 1, being securely mounted at an inner longitudinal strut 17 of the inner telescopic part 13.

It will readily be appreciated from this mounting arrangement that shifting the piston makes it possible to define the position of the two telescopic parts 12 and 13, i.e. to position these telescopic parts relative to each other. Located between the cylinder bottom 3 and the right-hand face end of the piston 2 is the pressurizing space 18 of the fixing means 10. A ring seal 19 on the piston 2 prevents any leakage of the fluid present in the pressurizing space 18 beyond the piston/cylinder wall.

At the right-hand lower edge of the cylinder 1 the pressurizing space in accessible from without through a filter port 14 which in the condition as shown is closed off by a sealing ring with the screw plug 15. When the pressurizing space 18 is filled with fluid, i.e., for example, hydraulic fluid or grease, the piston is unable to shift horizontally in this condition, thus retaining the fixed position of the telescopic parts 12 and 13.

Also evident in the upper middle portion of the piston 2 and of the cylinder 1 is a screw 11 provided as a torsion lock which can be likewise screwed into place with a specific clearance once the piston position has been fixed. Via a vent passage 20 the screw hole may also be used as a means of venting the pressurizing space 18, this being the reason why the screw 11 is sealed in its mount by means of a sealing ring (not shown).

When the telescopic parts 12 and 13 are positioned relative to each other the screw plug 15 needs to be removed to permit flow of a pressurizing fluid (hydraulic fluid or grease) into the pressurizing space 18 or to drain it therefrom. For this purpose the filler port 14 is accessible via two openings 20, 20' in the telescopic parts. When the screw plug 15 is removed the pressurizing space 18 becomes de-pressurized, after which, for example, a grease pump can be secured to the filler port through the openings 20, 20' and sealed so that by means of a hose pressurized fluid can be pumped into the pressurizing space 18 initially until the face surface area 7 comes into snug contact with the surface area section 8 of the telescopic part 12. After having removed the pressurized fluid connection the screw plug 15 can then be returned in place, thus locking the fixed position.

The invention thus provides a means of precisely and infinitely setting telescopic parts having curved lower shell parts from without with facilitated access, having no drawback as regards the steady-state loading capacity.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A guidance actuator assembly for laterally positioning and fixng the telescopic sections of a boom, said sections including inner and outer telescopic sections, an improvement in the actuator assembly comprising:

a cylinder tube having an open end, said cylinder tube being mounted within the inner telescopic section, the open end extending through the inner telescopic section into proximity with a bearing assembly on the outer telescopic section;

a piston reciprocally movable in the tube, the piston having an actuator end extendible through the open end of the tube into contact with the bearing assembly on the outer telescopic section for positioning the telescopic sections relative to each other; and a chamber in said tube, said chamber containing an incompressible fluid therein;

said bearing assembly including a planar surface area parallel to an opposed planar surface on the actuator end of the piston, the respective planar surfaces areas being positioned parallel to directions of maximum deformation forces on the telescopic sections.

2. The actuator assembling of claim 1 wherein said piston is shiftable laterally of longitudinal axes of the telescopic parts in a horizontal plane.

3. The actuator assembly of claim 1, wherein the telescopic boom is a crane jib having a vertically oriented longitudinal center plane, and comprising at least two of said actuator assemblies positioned respectively on opposite sides of the vertically oriented longitudinal center plane.

4. The actuator assembly of claim 3, wherein the telescopic parts of the jib have rectangular upper sections joined to outwardly curved lower sections, and said actuator assemblies are positioned in the lower curved sections.

5. A guidance actuator assembly for laterally fixing the telescopic parts of a boom, said parts including inner and outer telescopic parts, an improvement in the actuator assembly comprising:

a cylinder tube having a closed end and an open end, said closed end being mounted within the inner telescopic part, the open end extending through the inner telescopic part into proximity with a bearing assembly on an inner surface of the outer telescopic part;

a piston reciprocally movable in the tube, the piston having a drive end opposite the closed end of the tube and an actuator end extendible through the open end of the tube into contact with the bearing assembly on the outer telescopic part;

a chamber in said tube defined between the drive end of the piston and the closed end of the tube, said chamber containing an incompressible fluid therein;

a fluid port in said tube communicating with the chamber for supplying the incompressible fluid to the chamber, and being capable of venting the chamber to depressurize the chamber;

a plug removably mounted in said port for normally sealing said port when disposed therein, and permitting the incompressible fluid to be supplied via said port to said chamber when removed therefrom, and apertures in the inner and outer telescopic parts providing access to said plug from outside of the outer telescopic part to insert or remove the plug from the port; and a mechanical lock for securing the actuator end of the piston against the bearing assembly.

6. A guidance actuator assembly for laterally positioning and fixing the telescopic sections of a boom, said sections including inner and outer telescopic sections, an improvement in the actuator assembly comprising:

a cylinder tube having an open end, said cylinder tube being mounted within the inner telescopic section, the open end extending through the inner telescopic section into proximity with a bearing assembly on the outer telescopic section;

a piston reciprocally movable in the tube, the piston having an actuator end extendible through the open end of the tube into contact with the bearing assembly on the outer telescopic section for positioning the telescopic sections relative to each other;

a chamber in said tube, said chamber containing an incompressible fluid therein;

a fluid port in said tube communicating with the chamber for supplying the incompressible fluid to the chamber, and being capable of venting the chamber to depressurize the chamber;

a plug removably mounted in said port for normally sealing said port when disposed therein, and permitting the incompressible fluid to be supplied via said port to said chamber when removed therefrom, and apertures in the inner and outer telescopic sections providing access to said plug from outside of the outer telescopic section to insert or remove the plug from the port.

7. The actuator assembly of claim 6 wherein said bearing assembly includes a guide plate secured to the inner surface of the outer telescopic part, said guide plate having a bearing surface for engaging the actuator end of said piston.

8. The actuator assembly of claim 6, wherein said incompressible fluid is oil.

9. The actuator assembly of claim 6, wherein said incompressible fluid is grease.

10. The actuator assembly of claim 6, wherein the telescopic boom is a crane jib having a vertically oriented longitudinal center plane, and comprising at least two of said actuator assemblies positioned respectively on opposite sides of the vertically oriented longitudinal center plane.

11. The actuator assembly of claim 10, wherein the telescopic parts of the jib have rectangular upper sections joined to outwardly curved lower sections, and said actuator assemblies are positioned in the lower curved sections.

12. A method for positioning and fixng the relative lateral positions of inner and outer telescopic sections of a crane jib comprising the steps of:

a) providing a guidance actuator assembly for laterally fixing the telescopic sections, the actuator assembly including;

a cylinder tube having an open end, said cylinder tube being mounted within the inner telescopic section, the open end extending through the inner telescopic section into proximity with a bearing assembly on the outer telescopic section;

a piston reciprocally movable in the tube, the piston having an actuator end extendible through the open end of the tube into contact with the bearing assembly of the outer telescopic section;

a chamber in said tube, said chamber containing an incompressible fluid therein;

a fluid port in said tube communicating with the chamber for supplying the incompressible fluid to the chamber and venting the chamber to depressurize the chamber; and a plug removably mounted in said port;

b) removing the plug from the port;

c) filling the chamber with incompressible fluid through the port until the actuator end of the piston snugly engages the bearing assembly to thereby position the telescopic sections in desired positions relative to each other; and d) re-inserting the plug into said port to secure the piston snugly against the bearing assembly.

* * * * *